United States Patent [19]

Hiroshima

[11] Patent Number: 4,863,035

[45] Date of Patent: Sep. 5, 1989

[54] PACKAGING BOX THAT CAN EASILY BE OPENED

[75] Inventor: Wataru Hiroshima, Tokyo, Japan

[73] Assignee: Konica Corporation, Tokyo, Japan

[21] Appl. No.: 167,166

[22] Filed: Mar. 11, 1988

[30] Foreign Application Priority Data

Mar. 13, 1987 [JP] Japan ..... 62-37283[U]
Nov. 19, 1987 [JP] Japan ..... 62-177147[U]

[51] Int. Cl.[4] ..... B65D 5/54

[52] U.S. Cl. ..... 206/620; 206/628; 206/629; 206/633

[58] Field of Search ..... 206/613, 608, 620, 621, 206/622, 624–626, 629, 633, 634, 631.1, 631, 459, 611, 628; 229/41 R, 41 B

[56] References Cited

U.S. PATENT DOCUMENTS

| | | | |
|---|---|---|---|
| 1,975,831 | 10/1934 | Daller | 206/624 X |
| 2,038,893 | 4/1936 | Davidson | 206/624 |
| 2,363,861 | 11/1944 | Goodyear | 206/615 |
| 3,093,292 | 6/1963 | Ahlbor | 206/625 |
| 3,194,474 | 7/1965 | Rumberger | 206/459 X |
| 3,263,900 | 8/1966 | Link et al. | 206/611 X |
| 3,572,576 | 3/1971 | Foster | 206/625 |
| 4,141,449 | 2/1979 | Stone | 206/624 X |
| 4,284,197 | 8/1981 | Meyers | 206/626 |
| 4,441,612 | 4/1984 | Kingsley et al. | 206/620 |
| 4,584,202 | 4/1986 | Roccaforte | 206/611 X |
| 4,623,074 | 11/1986 | Deerwester | 206/620 X |
| 4,643,315 | 2/1987 | Hopwood et al. | 206/620 |

FOREIGN PATENT DOCUMENTS

| | | | |
|---|---|---|---|
| 104473 | 7/1938 | Australia | 206/611 |
| 1484758 | 5/1967 | France | 206/625 |
| 645224 | 9/1962 | Italy | 206/626 |

*Primary Examiner*—Bryon P. Gehman
*Attorney, Agent, or Firm*—Finnegan, Henderson, Farabow, Garrett, & Dunner

[57] ABSTRACT

A packaging box and a method of packaging wherein a paste flap is bonded to an end of side wall sections interconnected with each other through folding lines to form a square cylinder, inner flaps, bonding flaps and end sections provided at each end of the side wall sections are folded, and the bonding flaps and the end sections are bonded together. A perforated line is provided on the paste flap and the side wall section. The perforated line extends from the external side of the paste flap excluding its folding line, cuts across the folding line, extends into the side wall section, cuts across the folding line back again, and extends to the external side of the paste flap. A perforated line extends from one side of the paste flap excluding its folding line, runs along a non-bonding portion provided in the paste flap, cuts across the folding line, extends into the side wall section, cuts across the folding line back again, and extends to the other side of the paste flap.

7 Claims, 2 Drawing Sheets

PACKAGING BOX THAT CAN EASILY BE OPENED

BACKGROUND OF THE INVENTION

1. Field of the Invention

The present invention relates to a packaging box and the method of packaging and more specifically to a packaging box which can easily be opened and the method of assembling the packaging box.

2. Description of the Prior Art

In the process of making a packaging box and of packing and sealing a product or article in it, a paper board is formed into a square cylinder; the product is inserted in it; inner flaps 10, 11, 12, 13, bonding flaps 8, 9 and end sections 6, 7 are folded in that order; and the bonding flaps 8, 9 and the end sections 6, 7 are joined to seal the product. As an example of the conventional method of making the packaging box with a feature that allows easy opening of the box for extracting the contents and which permits information printing on the inner surface, the Japanese Utility Model Laid-Open No. 1982 and No. 89/1984 may be cited. That is, a perforated line is cut along the folding line 14 on one side of the end section or on that part of the end section near the folding line but not adjoining the bonding flap 8 or 9 to make easy the opening of only the end section of the box together with the bonding flap joined to it. Another example is the one in which the perforated line is cut extending from one corner of a particular side wall section 1, 2, 3 or 4, toward the opposing corner without passing the folding line. Or the perforation starts at the external side of one of the inner flaps, passes through the side wall section adjoining the inner flap and reaches the external side of the other inner flap that opposes the first inner flap. In this example, the box is easily opened for extracting the contents by breaking the side wall section along the perforated line and lifting it toward the other side wall section.

The problem of these conventional arts is that when perforation is cut on the folding line of one of the end sections or near the folding line, the inner flap cannot be lifted. Because of this drawback, this method is not so effective in facilitating the opening of the box.

Another disadvantage is that since the perforation is cut in only one of the end sections, the opposing end sections have unequal folding strengths and thicknesses. As a result, in the packaging process of inserting and sealing an article in the box, i.e., when many stacked two-folded flat boards are successively taken out one at a time and formed into a square cylinder, troubles occur such as failures to extract boards correctly or form the boards into the correct shape, thus deteriorating the efficiency of the packaging process.

There is a further drawback. When the perforation is cut through a particular side wall section, the length of the perforation is longer than at least one of the sides of the box. In that case when it is attempted to open the box, the breaking of perforation will not propagate continuously to those remote parts of the perforation away from the force application point and may deviate from the perforation into other parts of the side wall section.

Therefore, it is necessary to avoid printing information on the inside of the side wall section through which the perforation passes and this reduces the effective area available for printing.

SUMMARY OF THE INVENTION

The objective of the invention is to provide a packaging box and the method of packaging using the box which can easily be opened for extracting the contents and which allows the user to readily read the information printed inside the packaging box.

The above objective can be achieved by a packaging box which is characterized by a perforated line that extends from a part of external sides of a paste flap excluding its folding line, across the folding line, into a side wall section, across the folding line back again, and into the paste flap.

The above objective can be achieved by a packaging box assembled in the steps of pasting a paste flap with an end of side wall sections interconnected with each other through folding lines to from a square cylinder, inserting a product inside the square cylinder, folding inner flaps, bonding flaps and end sections provided at each end of the side wall sections, and bonding together the bonding flaps and the end sections; characterized by a perforated line that extends from a part of external side of the paste flap excluding its folding line, runs along a non-bonding portion provided in the paste flap, cuts across the folding line, extends into the side wall section, cuts across the folding line back again, and extends to the external side of the paste flap.

The above objective can also be realized by a method of assembling a packaging box comprising the steps of pasting a paste flap with an end of side wall sections interconnected with each other through folding lines to form a square cylinder, inserting an article into the square cylinder, folding inner flaps, the bonding flaps and end sections provided at each end of the side wall sections, and bonding together the bonding flaps and the end sections.

DESCRIPTION OF THE PREFERRED EMBODIMENTS

FIGS. 1 A and 1 B are developed front views of the unfolded packaging box as an embodiment of this invention.

Figure 2:
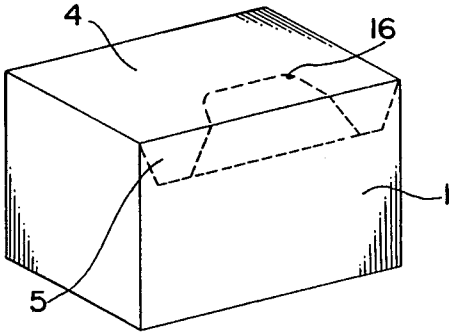
FIG. 2 is an explanatory view of the packaging box assembled.
Figure 3:
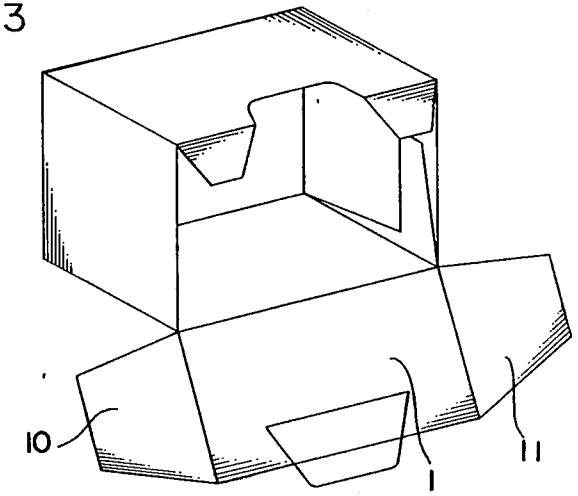
FIG. 3 is a perspective view showing the opened packaging box.
Figure 1A:
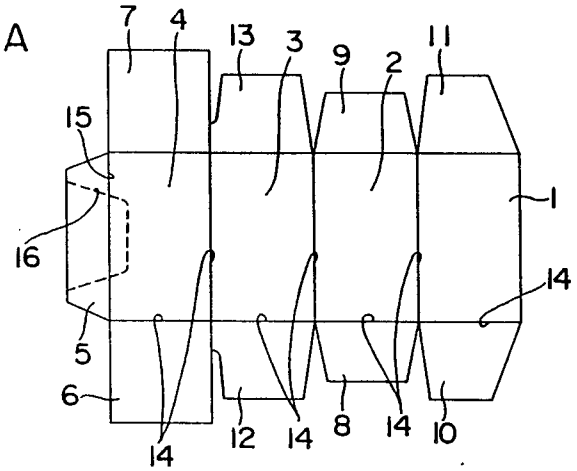
FIG. 1A and 1 B are developed plan views of the unfolded end packaging box of this invention.
Figure 1B:
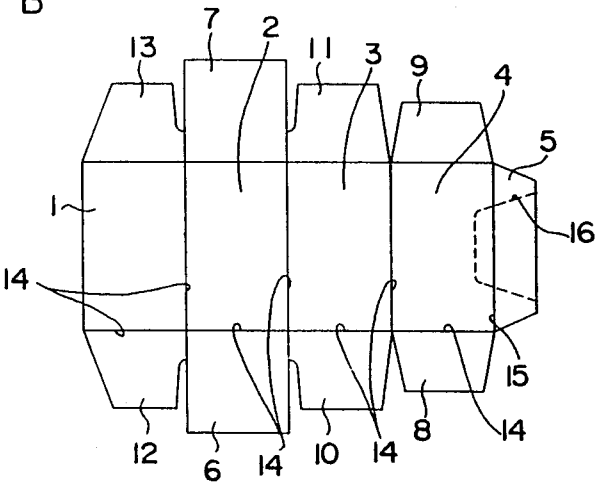

The packaging box is made of a carton or a paper board that has side wall sections 1, 2, 3, 4, a paste flap 5, end sections 6, 7, inner flaps 10, 11, 12, 13, and bonding flaps 8, 9, all interconnected through folding lines 14, 15 as shown in FIG. 1A and 1B.

First, the paste flap 5 and the side wall section 1 are joined to form the paper board into a square cylinder. An article or product is put inside the square cylinder box and the inner flaps 10, 11, 12, 13, the end sections 6, 7, and the bonding flaps 8, 9 are folded and then the end sections 6, 7 are joined to the bonding flaps 8, 9 to contain the product inside. The packaging box of this invention has a folding line 15 and a paper board extending therefrom defining the paste flap 5, and a perforated line 16 starting at one point on an external side of the paste flap 5, cutting across the folding line 15 into the side wall section 4, extending along the folding line 15, cutting across the folding line 15 back again and reaching the external side of the paste flap 5.

In removing the contents of the paper box, the box is broken open by press-cutting the perforated line 16 and pulling the broken flap section toward the side wall section 1. The side wall section 1 along with the broken flap section demarcated by the perforated line 16 is then separated from the pasted surface between the paste flap 5 and the side wall section 1 and is opened together with the inner flaps 10, 11 in the case of FIG. 1A or, in the case of FIG. 1B, the inner flaps 12, 13. In this way the box can easily be opened and the contents taken out.

When information is to be printed on the inner surface of the packaging box, it can be put on any side wall section except for parts required for pasting and be readily noticed and read.

As described above, in this invention a breakage surface produced by breaking the perforated line is formed in the bonding surface which has the smallest strength among the sections forming the square cylinder of the packaging box to ensure that the square cylinder box breaks from the bonding surface along the perforated line. Compared with the conventional technique in which the perforated line is formed on a side wall section, the perforated line on the side wall section can be reduced in its length to one-half or less. Since the perforated line is cut along the direction of shearing required for breaking, the break can reliably propagate along the perforated line and be prevented from advancing into those portions of the side wall section other than the perforated line.

Thus, when information is to be printed on the inner surface of the box, all the internal areas of the four side wall sections except for parts for pasting can be used for information printing.

Furthermore, since the perforated line length on the side wall section is shorter and the area demarcated by the perforated line and the folding line is also smaller, no problem will develop when a conventional packaging machine is used in the packaging process where the product is put inside the two-folded flat board which is then assembled into the square cylinder to pack and seal the product. Also, this packaging method can minimize the restrictions on design printing on the box surface.

This invention therefore provides a packaging box which can be opened easily for taking the contents out and which permits the user to readily read the information printed on the inside of the box.

In the above embodiment, however, it is necessary to break the pasted surface when opening the box. This reduces the package opening performance. Another disadvantage of this embodiment is that when the paste flap and the side wall section are pasted together, the paste seeps through the perforated line 16 smearing anything in contact with the package.

Figure 6:
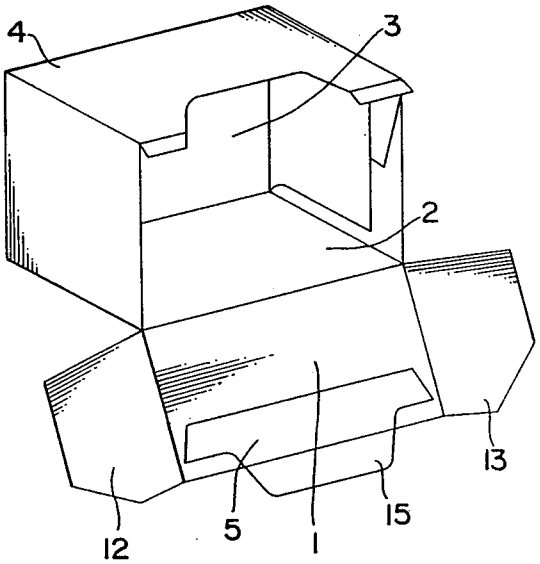
FIG. 6 is a perspective view of the opened packaging box of FIG. 5.
Figure 5:
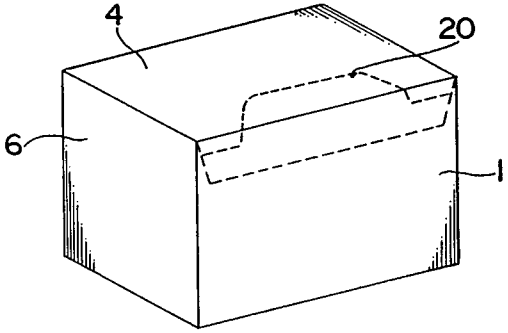
FIG. 5 is a perspective view of the assembled packaging box of the second embodiment.
Figure 4:
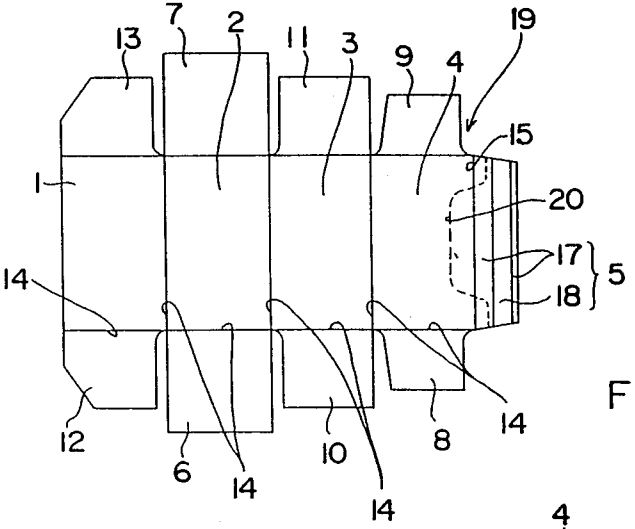
FIG. 4 is a developed plan view of an unfolded packaging box of another embodiment.

This problem is solved by another embodiment shown in FIGS. 4 through 6. The paste flap 5 is provided with non-bonding portions (no-paste portions) 17 between which is interposed a bonding part (pasted part) 18. The inner flaps 12, 13 extending from the side wall section 1 to which the paste flap 5 is bonded have their corners cut away slantwise on the free ends on the paste flap 5 side. To provide U-shaped gaps between the inner flaps 10, 11, 12, 13, the bonding flaps 8, 9, and the end sections 6, 7—with their edges opposing each other—a part 19 of their edges of, say, the inner flaps 10, 11, 12, 13 and the bonding flaps 8,9, is cut away.

The packaging box of this embodiment also has a perforated line 20 which begins at one of the external sides of the paste flap 5 excluding the folding line 15, runs on the non-bonding portion 17 of the paste flap 5, cuts across the folding line 15 that demarcates the paste flap 5, extends into the side wall section 4, runs along the folding line 15, and then cuts across the folding line 15 back again, runs on the non-bonding portion 17 until it reaches the other external side that is opposite to the starting side.

In this embodiment, when the paste flap 5 and the end of the side wall section 1 are to be bonded together to assemble the paper board into a square cylinder, the perforated line 20 extends through a part of the non-bonding portion 17, not through the pasted portion 18, so that no paste will seep through the perforation, preventing smearing of the box or devices handling the box.

For putting some information on the inner surface of the packaging box, the suitable locations may include the inner flaps 12, 13, side wall section 1, paste flap 5, and a part of the side wall section 4 cut by the perforation 20, because such locations stand out when the box is opened as shown in FIG. 6.

Moreover, this embodiment does not require the pasted surface to be broken in opening the box, the corners of the inner flaps 12, 13 are cut away and the U-shaped gaps are formed, all these combining to enhance the ease with which the box can be opened. The perforation is formed on the non-bonding portion of the paste flap, so that the paste will not seep through the perforation, preventing the smearing of the box or the devices handling the box. Also, information can be printed on the inner surface of the box over the area of four side wall sections except for parts to be pasted.

What is claimed is:

1. A packaging box comprising:

first, second, third and fourth side walls, each of said side walls having first and second opposed, substantially parallel lateral edges and first and second opposed, substantially parallel longitudinal edges, said first and second side walls being joined at the second and first lateral edges thereof, respectively, said second and third side walls being joined at the second and first lateral edges thereof, respectively, and said third and fourth side walls being joined at the second and first lateral edges thereof, respectively;

first, second, third, and fourth pairs of flaps connected to the longitudinal edges of the first, second, third, and fourth side wall, respectively;

a paste flap having a first and second lateral edges and first and second longitudinal edges, the first lateral edge of the paste flap being joined to the second lateral edge of the fourth side wall, the paste flap bonded to said first side wall, said paste flap including at least first and second non-bonding portions and at least one bondable portion disposed between said first and second non-bonding portion for bonding to said first side wall, said first non-bonding portion being contiguous with said first lateral edge of said paste flap and said second non-bonding portion being contiguous with said second lateral edge of said paste flap; and a continuous perforated line that defines an area including at least part of the paste flap and at least part of the fourth side wall, said continuous perforated line intersecting said first longitudinal edge of said paste flap within said first non-bonding portion at one end thereof and intersects said second longitudinal edge within said first non-bonding portion at the other end thereof.

2. A packaging box as claimed in claim 1, wherein said first and third pairs of flaps comprise inner flaps.

3. A packaging box as claimed in claim 1, wherein said second pair of flaps comprise end sections.

4. A packaging box as claimed in claim 3, wherein said fourth pair of flaps comprise bonding flaps, said bonding flaps being bonded to said end sections.

5. A packaging box as claimed in claim 1, wherein the area defined by said perforated line is symmetrical with respect to a longitudinal center line passing through the centers of said paste flap and said first, second, third, and fourth side wall sections.

6. A packaging box as claimed in claim 1, wherein said first pair of flaps includes first and second lateral edges, said first lateral edges intersecting said first lateral edge of said first side wall section and form an acute angle with said longitudinal edges of said first side wall section.

7. A packaging box as claimed in claim 1, wherein said first, second, third, and fourth pairs of flaps have longitudinal gaps between adjacent flaps.

* * * * *